United States Patent [19]

Tanaka et al.

[11] 4,355,963

[45] Oct. 26, 1982

[54] HORIZONTAL ROTARY COMPRESSOR WITH OIL FORCED BY GAS DISCHARGE INTO CRANKSHAFT BORE

[75] Inventors: Hideharu Tanaka, Amagasaki; Koji Ishijima; Toshihide Koda, both of Shizuoka, all of Japan

[73] Assignee: Mitsubishi Denki Kabushiki Kaisha, Tokyo, Japan

[21] Appl. No.: 99,727

[22] Filed: Dec. 4, 1979

[30] Foreign Application Priority Data

Dec. 28, 1978 [JP] Japan ..... 53-166076
Jan. 5, 1979 [JP] Japan ..... 54-512[U]

[51] Int. Cl.[3] ..... F04C 18/00; F04C 29/02; F16N 7/30; F16N 21/00

[52] U.S. Cl. ..... 418/63; 418/88; 418/94; 184/6.16; 417/902

[58] Field of Search ..... 418/63, 88, 94, 97–100, 418/DIG. 1; 184/6.16; 417/902

[56] References Cited

FOREIGN PATENT DOCUMENTS

| | | | |
|---|---|---|---|
| 50-87512 | 7/1975 | Japan | 418/94 |
| 53-153518 | 12/1978 | Japan | 418/94 |
| 105560 | 7/1924 | Switzerland | 184/6.16 |

*Primary Examiner*—John J. Vrablik
*Attorney, Agent, or Firm*—Wenderoth, Lind & Ponack

[57] ABSTRACT

A horizontal rotary type compressor having a rotary compression unit hermetically contained in a closed shell has its lubricating parts effectively lubricated with the lubricating parts effectively lubricated with the lubricant oil being fed to the central lubrication bore formed axially in the crankshaft through a lubricant oil feed tube which is opened at one end within the lubricant oil accumulated on the bottom of the closed shell and adapted to be intermittently subjected to the refrigerant gas discharged from the compression unit.

2 Claims, 7 Drawing Figures

HORIZONTAL ROTARY COMPRESSOR WITH OIL FORCED BY GAS DISCHARGE INTO CRANKSHAFT BORE

BACKGROUND OF THE INVENTION

1. Field of the Invention

This invention relates to a rotary type compressor and more particularly to a lubrication system in a horizontal rotary type compressor.

2. Description of the Prior Art

Recently rotary type compressors have been widely used in household refrigerators, air-conditioning apparatuses, etc. because it is possible to make the compressor compact. In the field of application of rotary type compressors in refrigerators, etc. it is often the case that in installing it less space is required when it is installed horizontally, that is, when the peripheral side surfaces of its cylindrical outer configuration are laid horizontally rather than being installed otherwise.

In such a horizontal rotary type compressor the lubrication has hitherto been carried out in such a manner that the crankshaft was dipped in lubricant oil accumulated in the lower part of the closed shell and the lubricant oil was supplied to the various parts from the end of the crankshaft through a lubrication bore formed axially in the crankshaft by the use of a centrifugal lubricant oil pump, etc. connected to the crankshaft. However, in the case of a horizontal rotary type compressor, since the lubrication bore in the crankshaft is distant from the surface of the lubricant oil in the closed shell it has been a problem that such a lubrication system as conventional in a vertical rotary type compressor can not be adopted.

SUMMARY OF THE INVENTION

It is an object of the present invention to provide a new lubrication system for a horizontal rotary type compressor.

It is another object of the present invention to provide a means which has a simple construction and is reliable in operation for supplying lubricant oil into a lubrication bore formed centrally and axially in the crankshaft of a horizontal rotary type compressor.

It is a further object of the present invention to provide a means for supplying lubricant oil into a lubrication bore in a crankshaft of a horizontal rotary type compressor by the effective use of refrigerant gas discharged from the compression unit.

In accordance with the present invention a lubrication system for a horizontal rotary type compressor is provided in which lubricant oil accumulated in the bottom of a closed shell within which the compression unit is contained is supplied into the lubrication bore formed centrally and axially in the crankshaft by the effective use of the pulsation of a refrigerant gas under high pressure discharged from the compression chamber. For this purpose the horizontal rotary type compressor according to the present invention is provided with a lubricant oil feed tube, one end of which is in communication with the lubrication bore in the crankshaft, the other end of which is opened in the lubricant oil in the closed shell, and a refrigerant gas discharge pipe one end of which is put within one end of the lubricant oil feed tube opened into the lubricant oil, the other end of which is in communication with the refrigerant gas discharged from the compression chamber.

BRIEF DESCRIPTION OF THE DRAWINGS

The above brief description, as well as further objects, features and advantages of the present invention will be more fully understood by reference to the following detailed description of the presently preferred, but nonetheless illustrative embodiments in accordance with the present invention, when taken in conjunction with the accompanying drawings, wherein.

DESCRIPTION OF PREFERRED EMBODIMENTS

Figure 1:
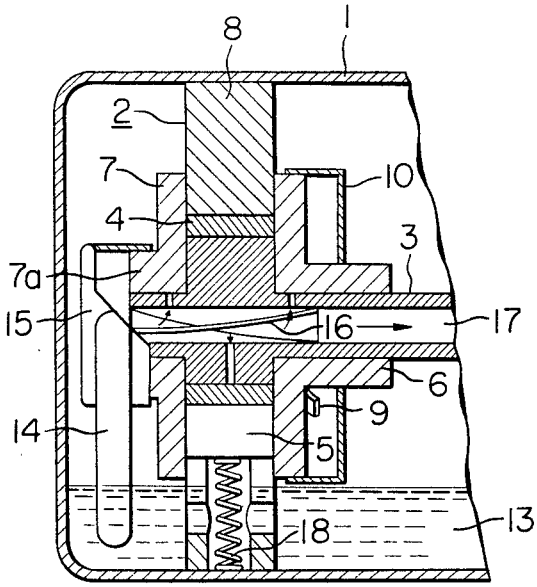
FIG. 1 is a longitudinal sectional elevational view of one embodiment of a horizontal rotary type compressor in accordance with the present invention.
Figure 2:
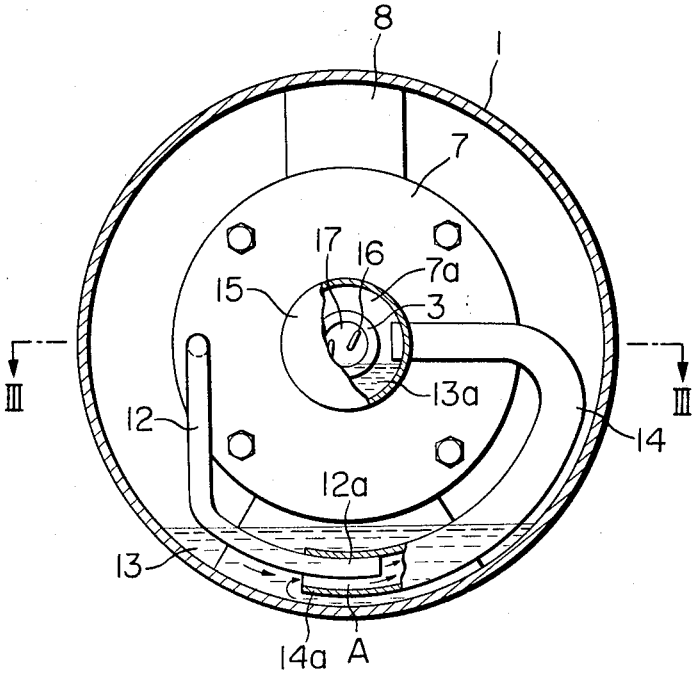
FIG. 2 is a longitudinal, partial sectional side view of the compressor shown in FIG. 1.
Figure 3:
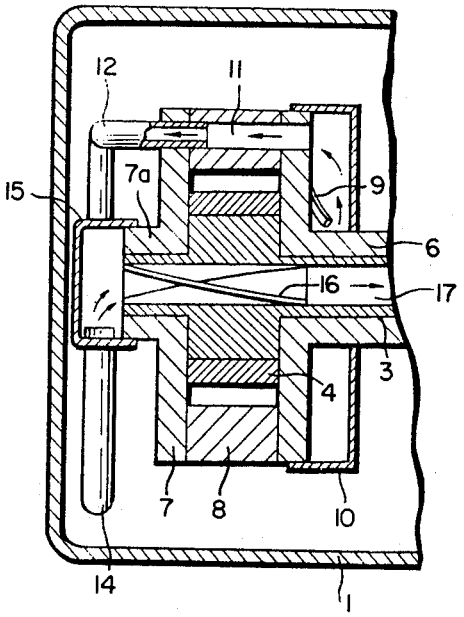
FIG. 3 is a crosssectional view taken along the line III—III of FIG. 2.
Figure 4:
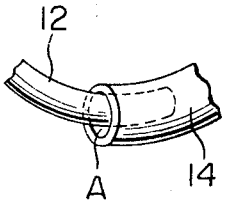
FIG. 4 is a partial perspective view showing the formation of the lubricant oil induction gap formed between a refrigerant gas discharge pipe and a lubricant oil feed tube.

FIGS. 1 to 4 show one embodiment of the present invention wherein 1 is a closed shell, in which is contained a rotary compressor unit which comprises a crankshaft 3 to be driven by an electric motor (not shown) or the like, a rolling piston 4 fitted on it, a vane 5 abutting at one end against piston 4 and adapted to be reciprocated by the eccentric motion of piston 4, a frame 6 as well as a cylinder head 7 to support crankshaft 3, and a cylinder 8 disposed between frame 6 and cylinder head 7. As well known in the art the inside of cylinder 8 is divided into a suction chamber and a compression chamber for a refrigerant gas by vane 5 so that the suction and the delivery of the refrigerant gas are repeated by the eccentric rotational motion of piston 4. Thus, the compressed refrigerant gas is discharged into a discharge-side silencer chamber 10 outside frame 6 through a discharge valve 9, flowing therefrom through a refrigerant gas orifice 11 formed through frame 6, cylinder 8 and cylinder head 7 as shown in FIG. 3 to be led into a refrigerant gas discharge pipe 12 one end of which is fitted in refrigerant gas orifice 11 to be fixedly secured to cylinder head 7, thereafter it passes through discharge pipe 12 and flows to the gas discharge end 12*a*. As shown in FIGS. 2 and 4 gas discharge end 12*a* of refrigerant gas discharge pipe 12 opens within one end 14*a* of a lubricant oil-gas feed tube 14 opened within or below the surface level of lubricant oil 13 accumulated on the bottom of closed shell 1. The other end of lubricant oil-gas feed tube 14, one end 14*a* of which is immersed in lubricant oil 13, opens into a bell-shaped lubricant oil-gas reservoir container 15 for feeding lubricant oil and gas mixed therewith which is mounted on cylinder head 7 so as to enclose a cylindrical part 7*a* projecting from the outer wall of cylinder head 7.

Therefore, since the refrigerant gas discharged from the compression chamber is discharged through gas discharge end 12*a* of refrigerant gas discharge pipe 12 into one end 14*a* of lubricant oil-gas feed tube 14, lubricant oil 13 accumulated in the lower part of closed shell 1 and mixed with gas is forced into lubricant oil-gas feed tube 14 through a gap A formed at the overlapping end portions 12*a* and 14*a* of refrigerant gas discharge pipe 12 and lubricant oil-gas feed tube 14 so that it is supplied into oil-gas container 15 together with the discharged refrigerant gas. Lubricant oil 13*a* thus collected in oil-gas container 15 is forced into a central lubrication bore 17 formed axially in crankshaft 3 by a screw blade 16 provided at one end thereof to be supplied to various shifting portions in a manner known per se. In FIG. 1 the reference numeral 18 shows a vane spring to thrust vane 5 against piston 4.

Figure 5:
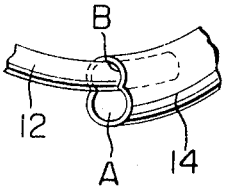
FIG. 5 is a partial perspective view showing a modification of the construction shown in FIG. 4.

FIG. 5 shows a variant form of the overlapping portion of refrigerant gas discharge pipe 12 and lubricant oil-gas feed tube 14 shown in FIG. 4 in which the end of oil-gas feed tube 14 is so shaped to represent two substantially circular crosssections connected to each other, whereby a lubricant oil induction opening A and an engaging opening B for receiving refrigerant gas discharge pipe 12 to secure it to lubricant oil-gas feed tube 14 are provided. This makes it possible to secure refrigerant gas discharge pipe 12 to lubricant oil-gas feed tube 14 more reliably while the existence of a lubricant oil induction opening A is ensured.

Figure 6:
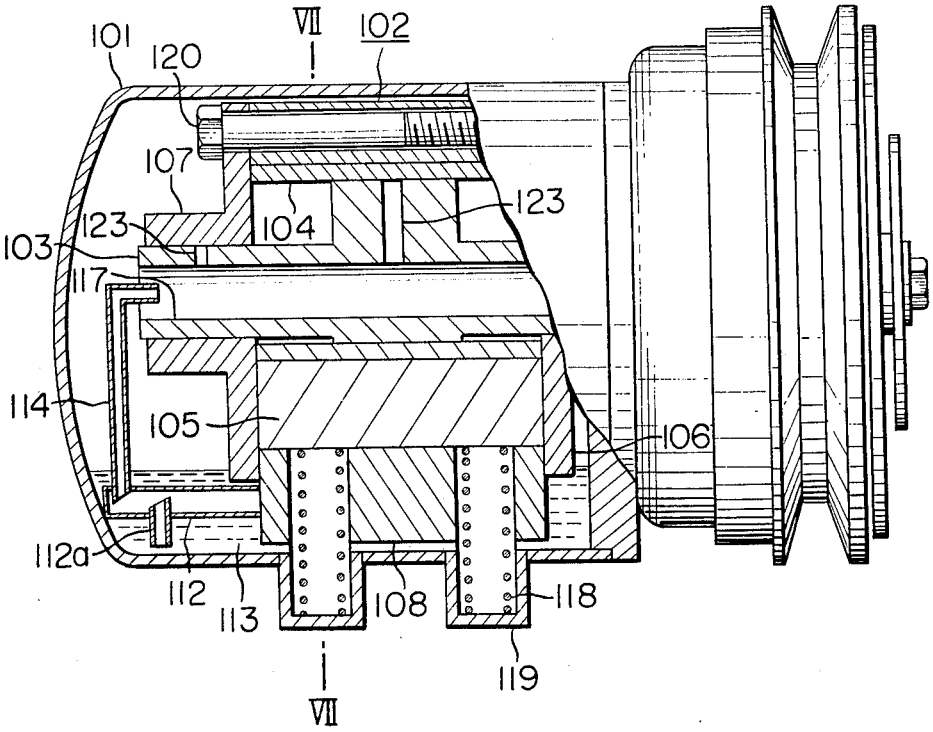
FIG. 6 is a longitudinal sectional elevational view of the essential portion of another embodiment of the present invention.
Figure 7:
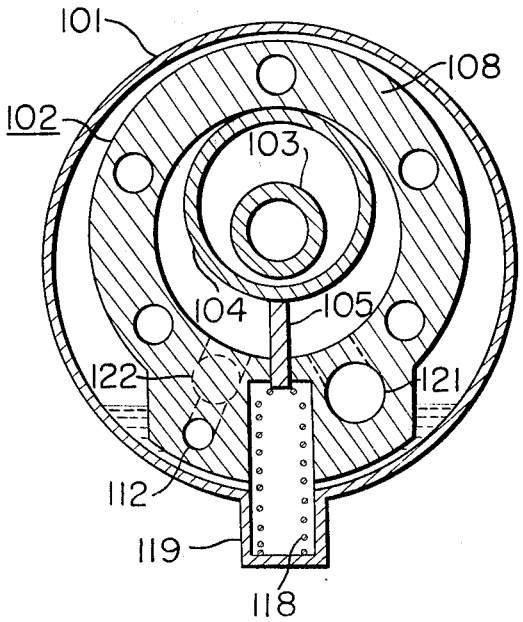
FIG. 7 is a longitudinal sectional side view of the compressor shown in FIG. 6 taken along the line VII—VII thereof.

FIGS. 6 and 7 show another embodiment of the present invention, wherein 101 is a closed shell within which is contained a rotary compression unit 102 comprising a crankshaft 103 to be driven by an electric motor, etc. (not shown), a rolling piston 104 fitted on crankshaft 103, a vane 105 abutting at one end against piston 104 to be reciprocated by the eccentric motion of piston 104, a frame 106 as well as a cylinder head 107 to support crankshaft 103 and a cylinder 108 located between frame 106 and cylinder head 107 to form a compression space. The inside of cylinder 108 is divided into a suction chamber and a discharge chamber of refrigerant gas by vane 105 as is well known in the art so as to repeat the suction and the discharge of refrigerant gas by the eccentric rotation of piston 104. The reference numeral 118 shows vane springs to urge piston 104 which are received in receiving pockets 119. Frame 106 and cylinder head 107 are securely fastened by a number of bolts 12*a*. Reference numerals 121 and 122 show a suction port and a discharge port for refrigerant gas, respectively, provided in cylinder head 107 or cylinder 108.

Fitted in discharge port 122 provided in cylinder 108 or cylinder head 107 is a refrigerant gas discharge pipe 112 which has hermetically connected thereto a suction pipe 112*a* at a lower portion, suction pipe 112*a* extending downwards and being open at its end near the bottom of closed shell 101. The other end of suction pipe 112*a* within discharge pipe 112 is cut obliquely so as to have the opening directed downstream so as to be subjected to a negative dynamic pressure relative to the flow of the discharged refrigerant gas, whereas the lower end of suction pipe 112*a* reaches near the inner wall of shell 101. A lubricant oil-gas feed tube 114 is introduced at the lower end thereof into refrigerant gas discharge pipe 112 so as to be hermetically connected thereto. The lower end of lubricant oil-gas feed tube 114 introduced into refrigerant gas discharge pipe 112 is cut obliquely to have the opening directed upstream so as to be subjected to a positive dynamic pressure of discharge refrigerant gas whereas the other or upper end of oil-gas feed tube 114 is bent in an L-shaped form to open within the end of a central lubrication bore 117 drilled axially in crankshaft 103. The reference numeral 123 designates a small hole formed in crankshaft 103 for supplying lubricant oil through which the lubricant oil is fed to various portions such as bearing parts of cylinder head 107, contacting portions between rolling piston 104 and crankshaft 103, contacting surfaces between rolling piston 104 and cylinder 108, contacting parts between vane 105 and cylinder 108, etc. Lubricant oil 113 accumulated in the bottom of closed shell 101 is regulated by any suitable means (not shown) such that the level of the lubricant oil is usually maintained somewhat higher than discharge port 122 for refrigerant gas.

Now the operation of the system shown in FIGS. 6 and 7 will be explained in reference thereto.

When crankshaft 103 is rotated by an electric motor (not shown) outside closed shell 101 through a transmission means such as a belt (not shown) rolling piston 104 is rotated to effect a suction-discharge operation, whereby each revolution of crankshaft 103 discharges the compressed refrigerant gas through discharge port 122. The discharged refrigerant gas flows into refrigerant gas discharge pipe 112. In this case, since the upper end of suction pipe 112*a* connected to discharge pipe 112 is cut obliquely so as to generate a negative dynamic pressure relative to the refrigerant gas flow, lubricant oil 113 accumulated in the bottom of closed shell 101 is sucked into discharge pipe 112 through suction pipe 112*a*. In this case, since the lower end of suction pipe 112*a* extends closely adjacent to the inner wall of closed shell 101, the supply of the lubricant oil is made possible even if the compressor is somewhat inclined. The lubricant oil thus sucked into discharge pipe 112 is intermittently delivered into lubrication bore 117 in crankshaft 103 through lubricant oil-gas supply tube 114. The lubricant oil thus fed into lubrication bore 117 is supplied to the various parts through small holes 123 provided everywhere in crankshaft 103 so that the lubrication and the seal of the refrigerant gas are carried out. Although in FIGS. 6 and 7 refrigerant gas discharge pipe 112 and lubricant oil-gas feed tube 114 are shown as being constituted separately, similar effects can be obtained even if they are integrally constituted.

In both embodiments, the gas mixed with the oil is returned to the interior of the shell through openings, such as the opening around the upper end of tube 114 in FIG. 6, (no similar opening is visible in FIGS. 1 and 3, and the gas is discharged from the casing through a discharge opening (not shown).

From the foregoing it will be appreciated that according to the present invention the feed of the lubricant oil to a crankshaft of a horizontal rotary type compressor is made possible by the effective use of the compressed refrigerant gas discharged from the compression chamber so that the problems concerning lubrication in a horizontal rotary type compressor can be resolved.

The invention has been described with particular reference to the preferred embodiments, but it will be understood that variations and modifications within the spirit and scope of the invention may occur to those skilled in the art to which the invention pertains.

What is claimed is:

1. A horizontal rotary type compressor comprising:

a closed shell;

a rotary compression unit housed within said closed shell, said rotary compression unit having a cylinder, a cylinder head and a frame enclosing both ends of said cylinder, a piston eccentrically rotatable in said cylinder about an axis extending horizontally, a crankshaft fitted in said piston and having a central axial lubrication bore, and a vane dividing the space defined within said cylinder by said piston, cylinder head and frame into a suction and compression chamber;

said rotary compression unit further having a refrigerant discharge port;

a refrigerant gas discharge pipe connected at one end to said refrigerant gas discharge port and having the other end arcuately shaped and positioned below the surface level of lubricant oil accumulated in the bottom of said closed shell;

and a lubricant oil-gas feed tube having one end arcuately shaped and disposed below the surface level of lubricant oil in the bottom of said closed shell and having the other end opening into said central lubrication bore in said crankshaft, said other end of said refrigerant gas discharge pipe extending into said one end of said lubricant oil-gas feed tube, the portions of said discharge pipe and oil-gas feed tube which are below the surface level of lubricant oil being of substantially uniform diameter, said lubricant oil-gas feed tube portion having a larger diameter than said refrigerant gas discharge pipe portion for leaving a lubricant oil induction gap between the inner periphery of said lubricant oil-gas feed tube and the outer periphery of said other end of said refrigerant gas discharge pipe within the one end of said lubricant oil-gas feed tube, whereby lubricant oil accumulated in the bottom of said closed shell is supplied to said lubrication bore in said crankshaft by the injection of refrigerant gas discharged from said compression chamber into said lubricant oil-gas feed tube through said refrigerant gas discharge pipe.

2. A horizontal rotary type compressor as claimed in claim 1 further comprising a cup-shaped lubricant oil-gas collecting container mounted on said cylinder head so as to be positioned over the end of said crankshaft, the end of said lubricant oil-gas feed tube opening into said lubricant oil-gas collecting container.

* * * * *